United States Patent [19]

Wolfe

[11] Patent Number: 4,679,822

[45] Date of Patent: Jul. 14, 1987

[54] INFORMATION DEVICES

[76] Inventor: Maynard F. Wolfe, c/o Woodcraft Investments Limited, 1501 Hitchinson House, Central, Hong Kong

[21] Appl. No.: 791,549

[22] Filed: Oct. 25, 1985

[30] Foreign Application Priority Data

Oct. 26, 1984 [GB] United Kingdom ..... 8427086

[51] Int. Cl.[4] ..... B42D 19/00; B65D 71/00; A45C 11/26; G09F 11/02

[52] U.S. Cl. ..... 281/5; 40/514; 206/225; 206/39.8

[58] Field of Search ..... 283/79; 281/2, 5; 40/111, 514; 206/225, 226, 39.8

[56] References Cited

U.S. PATENT DOCUMENTS

| | | | |
|---|---|---|---|
| 418,456 | 12/1889 | Gray | 281/5 |
| 601,416 | 3/1898 | Harrison | 40/514 |
| 686,324 | 11/1901 | McKay | 206/39.8 |
| 2,276,766 | 3/1942 | De Witt | 206/225 |
| 3,034,639 | 5/1962 | Fuerste | 206/39.8 |
| 3,443,683 | 5/1969 | Felty, Jr. et al. | 206/225 |
| 3,884,351 | 5/1975 | James | 206/225 |
| 4,026,485 | 5/1977 | Ambrose | 40/514 |
| 4,471,873 | 9/1984 | Thomas | 206/225 |

*Primary Examiner*—Paul A. Bell
*Assistant Examiner*—Paul M. Heyrana, Sr.
*Attorney, Agent, or Firm*—Franklin D. Wolffe; Morris Fidelman

[57] ABSTRACT

An information device comprises a relatively rigid support portion suitable for attachment to a person, animal or object, and a relatively flexible information label secured to the relatively rigid support portion. The secured label is extendable in use into an open state and also storable into a closed state either adjacent to or around the support portion. A cover member is provided to contain said secured label when stored relative the support portion.

13 Claims, 11 Drawing Figures

INFORMATION DEVICES

This invention relates to information devices which may for example carry personal information such as the name and address of the user and/or medical details.

Similar presently known information devices have a rigid label portion, which for convenience and ease of use is made relatively small in size. The information in these prior art devices cannot be kept private, whereby personal details which would not normally be made public such as allergies to certain drugs, diseases and disabilities like heart trouble, epilepsy etc. might be seen by a casual observer.

SUMMARY OF INVENTION

In accordance with the invention an information device comprises a relatively rigid support portion suitable for attachment to a person, animal or object, a relatively flexible information label capable of being secured to the relatively rigid support portion, the secured label being extendable in use into an open state and also storable into a closed state either adjacent to or around the support portion, and a cover member to contain the secured label when stored relative the support portion.

Such a device can not only carry much more detailed information, than for example prior art engraved or preprinted disc plates or cards, but also keep this information private until examined by those with a need to know. Such would encourage many more people to provide appropriate information on their person without embarrassment.

The cover member also provides a device in which the label is protected from wear and tear.

The support portion is suitably provided with a cap member with which the cover member engages, seals (e.g. gaskets or O rings) also being provided to give a water and air tight device.

The label is suitably made of thin material such that it can be easily stored either adjacent to or around the support portion for example by folding, coiling, wrapping or rolling of the label material.

Since a stored label will have a propensity to return to its original (i.e. coiled or folded) state when "opened-out", means are suitably provided to retain the label when needed in the extended, open and flat state, such that information therefrom can be easily obtained.

Such a retaining means may be holding means suitably a clip or hook provided on the side of the label opposite the side secured to the support portion, in which clip or hook is positioned a retaining member.

Alternatively the retaining means may be in the form of a pocket provided in the label along the longitudinal mid-point thereof, in which pocket is positioned a retaining member.

In a further embodiment, the retaining means may be in the form of hoops attached to the label, in which hoops a retaining member is inserted.

In yet a further embodiment, the retaining means may be in the form of an attachment member(s) on the label, to which attachment member(s) is connected a retaining member.

Preferably, the retaining member for any of the embodiments of retaining means is the cover member.

The cover member and support portion are advantageously held together on attachment means preferably a cord or chain whereby one cannot be totally separated from the other and lost.

Alternatively, the cover member and support portion are held together by the cover member being secured to one end of the label portion while the support portion is secured to the opposite end of the label portion.

An example of a specific application of this invention would be its use for medical identification purposes. The label in a folded, coiled or rolled position could be stored in the cover member, suitably a waterproof and fire resistant container, the identification device being attached to a chain, cord, clip, pin or any other device of a similar nature that can be attached to or worn by the user. Imprinted on the cover member could be, (as an example), the International Standards Organization symbol for "MEDICAL ALERT" as well as instructions how to open the device. An accident situation with the victim unable to talk or communicate and with perhaps the more conventional means of identification like a wallet or handbag lost or stolen would mean that the victim might not be able to indicate an allergy to drugs or a condition that could be complicated by regular treatment. The first aid team or the police would upon seeing the "MEDICAL ALERT" symbol on the device worn round the victim's neck or as a bracelet would then open the device and examine the label to read the information it contained. The label kept in an extended position by the retaining means provided would then serve to identify the wearer through the hectic process of an emergency admission to a hospital as well as speedier notification to the next of kin.

DETAILED DESCRIPTION OF THE PREFERRED EMBODIMENT

The information devices 10, 12, 14 and 16 shown in FIGS. 1 to 4 all comprise a support portion 18 for attachment to a person for example by a chain (not shown) passing through the loop 19 on the end of the portion 18, and an information label 20 secured to and wrappable around the portion 18.

Figure 5:
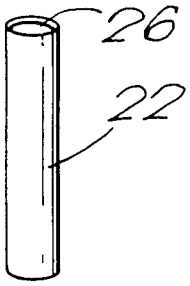
FIG. 5 shows a cover member suitable for use with the information devices of FIGS. 1 to 4.

The label 20 is relatively flexible whereby it may be wrapped around the relatively rigid support portion 18 for storage. In such a wrapped position, a hollow transparent or opaque cover member 22 as shown in FIG. 5 may be placed over the portion 18 and label 20 such that the cap member 24 provided on one end of portion 18 engages with the open end 26 of the cover 22. Sealing means (not shown) are provided between the cap member 24 and open end 26 of the cover 22 to give an air and water tight seal. The label 20 is also protected from wear and tear in such an arrangement.

In the devices shown in FIGS. 1 to 4, various means for retaining the label 20 in an extended, open and flat position are shown, when the cover 22 has been removed and the label 20 unfolded, uncoiled, unrolled or whatever. Such retaining means are required since the label 20 has a propensity to return to its prior wrapped state which is clearly a problem when information on the label is required.

Figure 1:
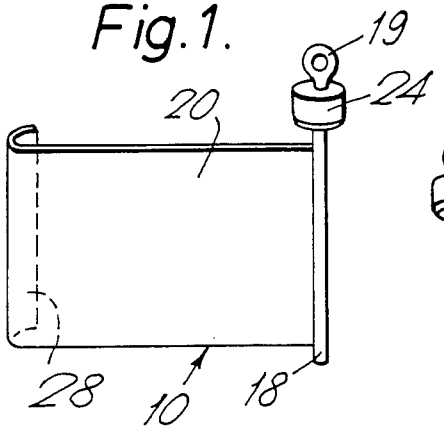
FIG. 1 shows a first embodiment of information device in accordance with the invention.

In the device 10 of FIG. 1, the retaining means takes the form of a hook or clip 28 provided on the unsecured side of the label 20, in which hook/clip 28 is placed a retaining member in the form of the removed cover member 22.

Figure 2:
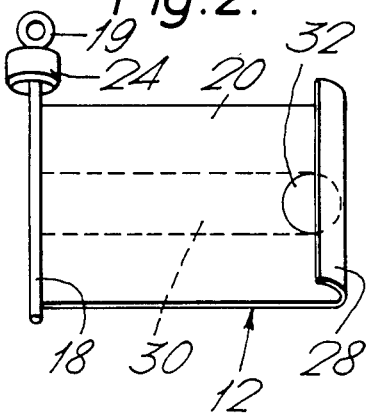
FIG. 2 shows a second embodiment of information device in accordance with the invention.
Figure 3:
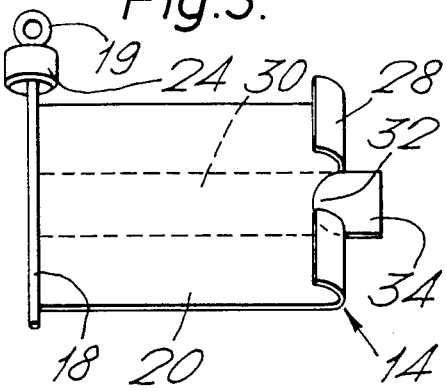
FIG. 3 shows a third embodiment of information device, in accordance with the invention.

In the devices 12 and 14 of FIGS. 2 and 3, the retaining means takes the form of a pocket 30 provided in the label 20, the pocket extending along the longitudinal mid-portion of the label, and in which the cover member 22 is inserted via the opening 32.

The pocket 30 alternatively or in addition can be used to carry further information (for example in the form of a microfilm or magnetic tape) to that contained on the label 20.

Figure 4:
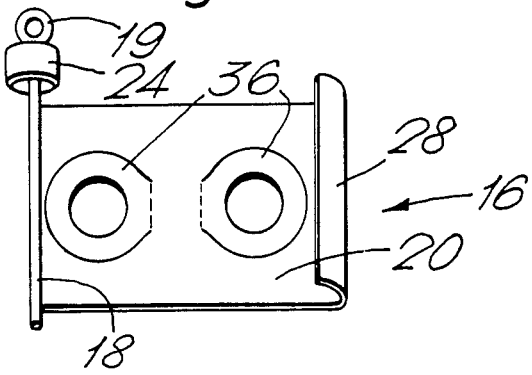
FIG. 4 shows a fourth embodiment of information device in accordance with the invention.

In the device 16 of FIG. 4, the retaining means takes the form of two hoops 36 in which the cover member 22 is inserted.

The hook/clip 28 on the labels 20 of FIGS. 2 and 4, meanwhile trap the cover member 22 in position and prevent the label 20 from accidentally returning to its stored position. Hook/clip 28 is preformed so it also can act as a clip holding the coiled label 20 and **20*a*** tightly rolled when stored.

Should a retaining member larger than the cover member 22 (e.g. a pencil) be required to keep extended the label 20, the centre part of the hook/clip 28 is provided as a flap 34 (see FIG. 3).

It should be noted that the hook/clip 28 shown in the devices 12, 14 and 16 could be used in any case together with the cover member 22 to act as the retaining means should it be preferred not to use for some reason, the pockets 30 or hoops 36.

Figure 6:
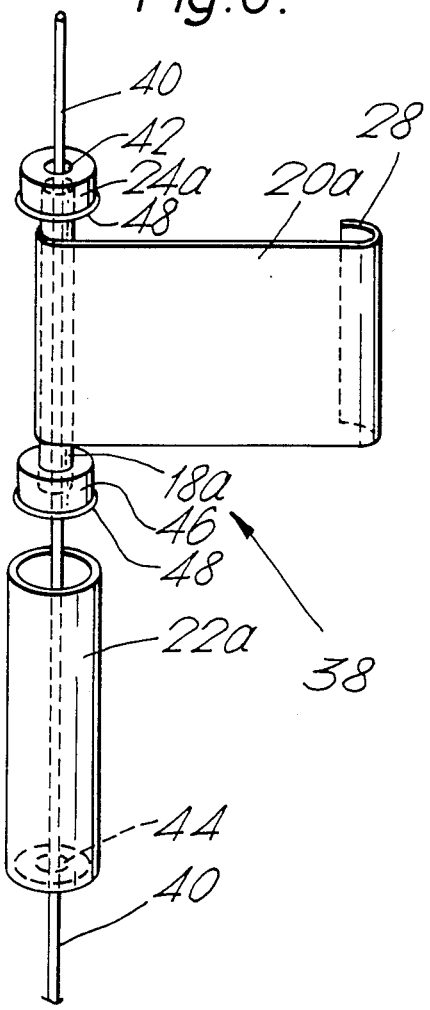
FIG. 6 shows a fifth embodiment of information device in accordance with the invention, in a first open position.
Figure 7:
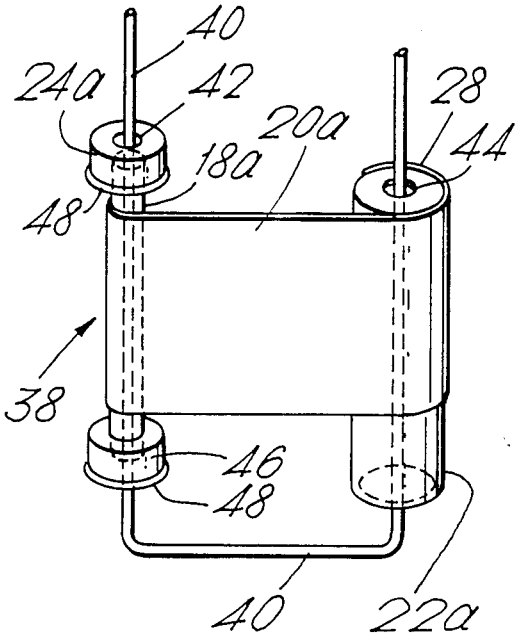
FIG. 7 shows the device of FIG. 6 in a second open position.

In the device 38 of FIGS. 6 and 7, a similar arrangement to that shown in FIG. 1 is illustrated, except in that instead of a loop 19, a cord or chain 40 is provided which passes firstly through a hollow bore 42 in support portion **18*a* and secondly through the hollow portion of the cover member 22*a* and a hole 44 in the base of the member 22*a***.

Such a cord or chain 40 connects together the support portion **18*a* and cover member 22*a*, whereby the two cannot be totally separated from each other and lost. In this embodiment, a sealing member 46 is provided at the bottom of the support portion 18*a* to act as a seal to any liquid which may enter the device 38 when closed via the hole 44 in the cover member 22*a***.

The cap member **24*a* and sealing member 46 are both provided on their underneath surface with a specific sealing "O" ring 48, which when the cover member 22*a* is positioned over the support member 18*a* and label 20*a*, causes the "O" ring 48** to deform and provide a water tight compartment between the two "O" rings.

Figure 8:
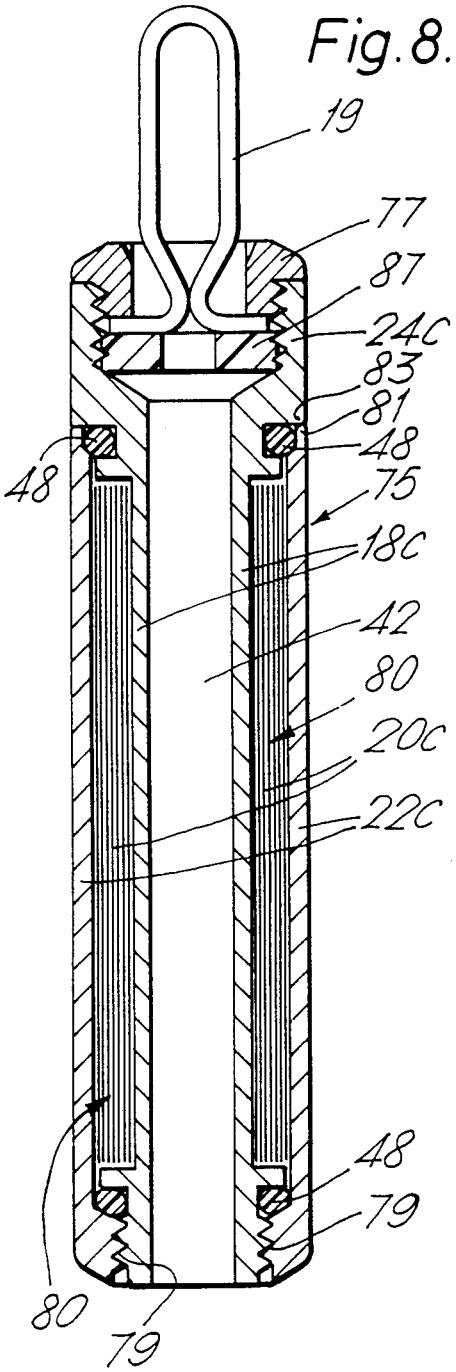
FIG. 8 shows a cross-section of a sixth embodiment of information device in accordance with the invention.

In the device 75 of FIG. 8, a similar arrangement to that shown in FIGS. 6 and 7 is illustrated, which device can be used either as shown with a loop 19 or with a cord or chain (not shown) passing through the hollow bore 42 of the support portion **18*c***.

In the latter case, a stop member in the form of a washer or C ring 87 is used to prevent relative movement between a cord or chain and the device 75. The C ring 87 is such that it can cope with any diameter of cord or chain, less than the diameter of the bore 42.

In FIG. 8, the loop 19 is screw cap fitted to the cap member **24*c* of the support portion 18*c* by a screw cap member 77, a gasket 87 (which alternatively acts as the stop member when a cord or chain is used) being provided to secure the loop 19 against the cap member 77**.

At the base of the device 75 the cover member **22*c* is secured to the support portion 18*c* by means of the screwthread 79. The area 80 containing the label 20*c* is water and air tight since the two O rings 48 are deformed when the cover member 22*c* is screwed onto the support member 18*c*. Furthermore, the upper O ring 48 is a dark colour in order to visually indicate to a user whether or not the device is fully closed (i.e. when the extension 81 of cover member 22*c* touches the ledge 83 of support portion 18*c*** leaving no gap through which the O ring is visible).

Figure 9:
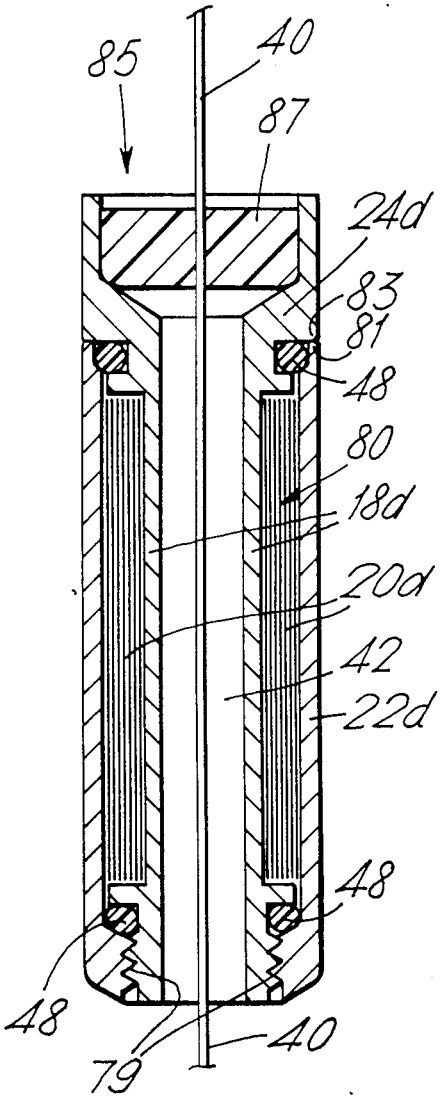
FIG. 9 shows a cross-section of a seventh embodiment of information device in accordance with the invention.

In the device 85 of FIG. 9, a similar arrangement to that shown in FIG. 8 is illustrated, except in that instead of a loop 19, a cord or chain 40 is provided passing through the hollow bore 42 in support portion **18*d*. A stop member in the form of a washer or C ring is fitted in the cap member 18*d* to prevent relative movement between the chain 40 and device 85, whereby the device 85 can be positioned at any point on the chain 40** a user may require.

Figure 11:
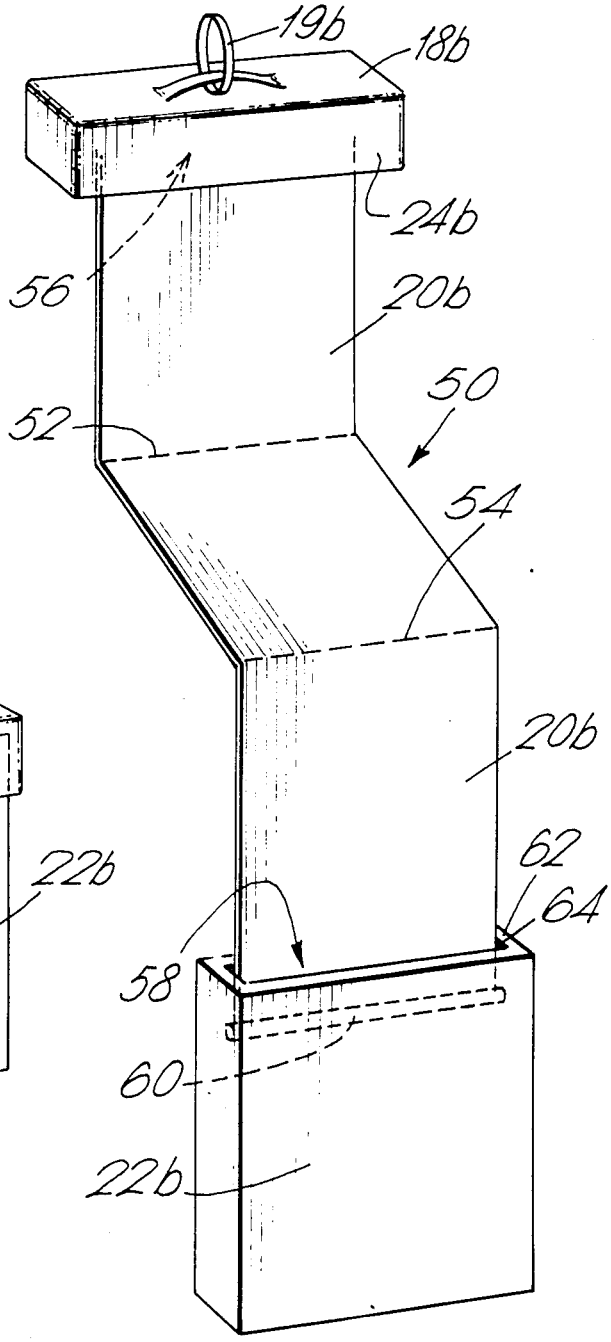
FIG. 11 shows the device of FIG. 10 in an open position.
Figure 10:
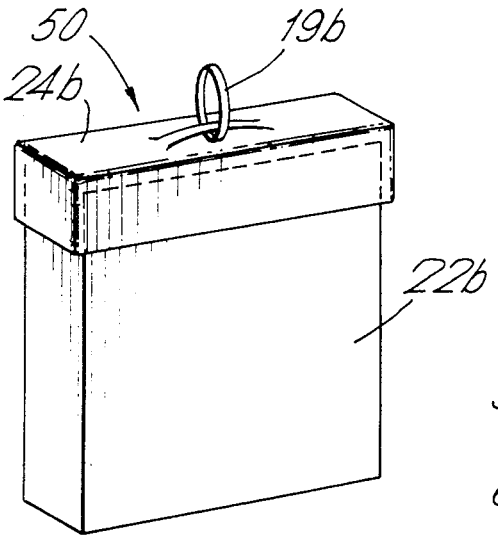
FIG. 10 shows an eighth embodiment of information device in accordance with the invention in a closed position.

The device 50 shown in FIGS. 10 and 11, comprises a support porton **18*b* and an indentity label 20*b* which is secured to and storable adjacent the portion 18*b* by means of folds (see dotted lines 52 and 54**).

In FIG. 10, the device 50 is shown in a closed position, a hollow cover member **22*b* placed over the folded label (not shown) and engages with the support portion 18*b* in the form of a cap member 24*b*. Sealing means (not shown) are provided between the cap member 24*b* and the upper end of the support portion 18*b* to give an air and water tight seal. The cap member 24*b* is provided with a loop 19*b*** through which a cord or chain may be passed whereby the device can be attached to a person.

The label **20*b* is specifically secured to the portion 18*b* by for example adhesive, pin, hook, bar or a spring loaded shaft, while the bottom end 58 of the label 20*b* is provided with an attachment member, specifically a pin, adhesive, hook, shaft or bar 60 which may also be spring loaded similar to that used to secure the label 20*b* to portion 18*b***.

A retaining member **22*b* is connected to the attachment member 60, in particular, the bar 60 is secured to the base of the cover member 22*b* or alternatively is unsecured but held captive within the confines of the cover member 22*b* by means of a lip or ledge 62 provided in the open end 64 of the member 22*b***.

In either case, the cover member **22*b* acts as a weight on the label 20*b* when removed from the cap member 24*b* to place the device 50 in an open position (See FIG. 11). In this open position, the label 20*b* is an extended form whereby information can be easily gleaned therefrom, the cover member 22***b* and bar 60 acting as retaining means to prevent the label from returning the its original folded state.

To place the device 50 back into its closed position (see FIG. 10), the label 20*b* is folded along the lines 52 and 54 and stored into the cover member 22*b*. The cover member 22*b* is then connected to the cap member 24*b* either by means of friction, a snap-fit or a locking device.

In the device shown in FIGS. 1 to 7, it should be noted that the cap members 24 and 24*a* and cover members 22 and 22*a* may be connected together either by means of friction, engaging screw threads or by a snap-fit. In an embodiment, the retaining member may be in the form of the cord or chain used to attach the device to the user, the cord or chain engaging the clip/hooks 28 by being "curved" therearound.

In the devices shown in FIGS. 1 to 9 and instead of the hook/clip 28, the retaining means could be a strip of fastening material preferably in the form of a velcro strip or adhesive coating provided adjacent the side of the label 20 opposite the side secured to the support portion 18 whereby when the label 20 is "opened-out", the velcro or adhesive is simply placed onto the users clothing.

A device in accordance with the invention has been found to be air-sealed and thus heat resistant upto high temperatures, and waterproof upto at least 50 m of depth.

The label 20 in any of the examples shown in FIGS. 1 to 11 is easily replaceable, exchanged or substitutable by another label 20 in order to update any information. Alternatively, the label 20 in use is simply revised. The label 20 may also be in the form of two identical labels back to back and joined at the edges (e.g. by lamination), thereby duplicating the information given on the label.

It should be noted in practise, that the support portion 18 and label 20 of the device are preferably initially supplied separately whereby information can be easily typed or written onto the label. Thereafter, the label 20 is secured to the support portion 18 (e.g. with a strip of adhesive coating provided on the side of the label 20), such that the label 20 can then be extended to read the information when needed, and stored relative the support portion 18 when not needed.

What I claim is:

1. An information device comprising:

a relatively rigid support portion suitable for attachment to an object, a relatively flexible information label capable of being secured to said relatively rigid support portion, said label when secured being extendable in use into an open state and also storable into a closed state relative said support portion, a separate cover member attachable to said support portion to contain said label after said label is stored in said closed state, and detachable from said support portion to allow said label to be extended into said open state, and sealing means for providing a water and air tight seal of an area containing said label when in said closed state.

2. A device as claimed in claim 1 wherein said support portion has a cap member with which said cover member engages to fully contain said label.

3. A device as claimed in claim 1 wherein said sealing means comprises at least one seal between said cover member and said support portion.

4. A device as claimed in claim 1 wherein said label is stored around said support portion.

5. A device as claimed in claim 1 wherein said label is stored adjacent to said support portion.

6. An information device comprising:

a relatively rigid support portion suitable for attachment to an object, a relatively flexible information label capable of being secured to said relatively rigid support portion, said label when secured being extendable in use into an open state and also storable into a closed state relative said support portion, a separate cover member attachable to said support portion to contain said label after said label is stored in said closed state and detachable from said support portion to allow said label to be extended into said open state, and means for retaining said label extended when in said open state, said remaining means having a length along which a retaining member is generally received and held thereby.

7. A device as claimed in claim 6 wherein said retaining means comprises a clip member, provided on a side of label opposite a side secured to said support portion, in which clip member is positioned said retaining member.

8. A device as claimed in claim 6 wherein said retaining means comprises a pocket, provided in said label, for receiving said retaining member.

9. A device as claimed in claim 6 wherein said retaining means comprises hoops attached to said label, in which hoops said retaining member is insertable.

10. A device as claimed in claim 6 wherein said retaining means comprises at least one attachment member on said label, to which attachment member is connected said retaining member.

11. A device as claimed in claim 6 wherein said retaining member comprises said cover member.

12. A device as claimed in claim 6 wherein said retaining means comprises a strip of adhesive material adjacent a side of said label opposite a side secured to said support portion.

13. A device as claimed in claim 6 wherein said cover member is secured to one end of said label, while said support portion is secured to the other end of said label.

* * * * *